United States Patent [19]

Stedman

[11] 4,140,186

[45] Feb. 20, 1979

[54] HEAVY-DUTY RIPPER FOR DUAL TRACTION UNIT

[75] Inventor: Robert N. Stedman, Chillicothe, Ill.

[73] Assignee: Caterpillar Tractor Co., Peoria, Ill.

[21] Appl. No.: 800,246

[22] Filed: May 25, 1977

Related U.S. Application Data

[63] Continuation-in-part of Ser. No. 614,813, Sep. 9, 1975, abandoned.

[51] Int. Cl.[2] ..... A01B 35/14

[52] U.S. Cl. ..... 172/292; 37/118 R; 172/276; 172/483; 172/780; 172/800; 180/14 A; 280/400

[58] Field of Search ..... 172/292, 276, 800, 484, 172/699, 780; 180/14 R, 14 A; 280/408, 405 B, 410, 400; 37/118 R, 129

[56] References Cited

U.S. PATENT DOCUMENTS

| | | | |
|---|---|---|---|
| 2,279,869 | 4/1942 | Houston | 172/276 |
| 2,732,196 | 1/1956 | Wood | 172/276 |
| 2,998,965 | 9/1961 | Larson | 172/699 X |
| 3,245,488 | 4/1966 | Peterson | 180/14 R |
| 3,266,816 | 8/1966 | Peterson et al. | 172/699 UX |
| 3,541,709 | 11/1970 | Comer, Jr. et al. | 37/118 R X |
| 3,581,827 | 6/1971 | Ratcliff | 172/699 X |
| 3,815,683 | 6/1974 | Collin, Jr. et al. | 172/699 X |
| 3,821,990 | 7/1974 | Elmslie | 172/292 |
| 3,884,310 | 5/1975 | Soucek et al. | 172/292 |

*Primary Examiner*—Paul E. Shapiro
*Attorney, Agent, or Firm*—John W. Grant

[57] ABSTRACT

An earthmoving apparatus has first and second traction units and a connecting device for connecting the second traction unit to the first traction unit in rearwardly spaced relationship. A ripper is carried by the connecting device intermediate the traction units. An adjusting device selectively adjusts the positioning of the ripper on the connecting device and includes a jack having a first portion carried by the connecting device and a second selectively extensible portion connected to the ripper for selectively positioning the ripper relative to and independently of the connecting device.

4 Claims, 4 Drawing Figures

HEAVY-DUTY RIPPER FOR DUAL TRACTION UNIT

CROSS REFERENCE TO RELATED APPLICATIONS

This application is a Continuation-in-Part of application Ser. No. 614,813 filed Sept. 9, 1975, now abandoned.

BACKGROUND OF THE INVENTION

1. Field of the Invention

This invention relates to earthmoving apparatus and in particular to heavy-duty rippers for installation on earthmoving apparatus.

2. Description of the Prior Art

To loosen earth for facilitated handling by bulldozers, scrapers and the like, the surface of the earth may be first treated by pulling a ripper therethrough. The ripper comprises a plurality of teeth, or ripper tips, which extend downwardly into the earth and rip furrows in the earth as the ripper is pulled along the surface.

Such ripping action requires a high tractive force. To provide such force, it has been conventional to use a pair of tractors. One such dual tractor arrangement is shown in U.S. Pat. No. 2,998,965 of Donald J. Larson, owned by the assignee hereof, wherein a push block on the draft assembly of a ripper is provided for receiving the thrust of a pushing tractor in addition to the dragging force applied through a shank-supporting pin on a pulling tractor.

In U.S. Pat. No. 3,266,816 of Robert A. Peterson et al, owned by the assignee hereof, a draft assembly is provided for use with tandem coupled tractors for distributing the stresses from a pulled ripper to the bodies of both tractors.

In Owen D. Evans' U.S. Pat. No. 3,496,844, a pair of traction units carries an intermediate digging, mixing, and earth moistening unit having harrow elements depending from a beam structure thereof. Means are provided for lowering and raising the harrow elements.

The Robert N. Stedman U.S. Pat. No. 3,552,497, owned by the assignee hereof, shows the use of a pair of tractors in side-by-side tandem relationship with a rear cross brace structure having a ripper tooth mounting member thereon.

In U.S. Pat. No. 3,245,488 of Robert A. Peterson, owned by the assignee hereof, and No. 3,324,963 of Donald H. Stroot et al, owned by the assignee hereof, steering controls for steering tractors in series tandem relationship are disclosed.

SUMMARY OF THE INVENTION

The present invention comprehends an improved earthmoving apparatus wherein ripper means are carried on a connecting means between series tandem traction units and are selectively adjustable by adjusting means carried on the connecting means. The connecting means may comprise a pivotable connection to the front tractor which may be readily disconnected by manipulation of the ripper means in a novel manner.

The traction units may comprise track-type tractors, dual-powered articulated scrapers, and the like.

According to the present invention, there is provided an earthmoving apparatus comprising a first traction unit, a second traction unit and connecting means for connecting the second traction unit to the first traction unit in rearwardly spaced relationship. A ripper is carried by said connecting means intermediate of said traction units. An adjusting means selectively adjusts the positioning of said ripper on said connecting means, said adjusting means incuding a jack having a first portion carried by said connecting means and a second selectively extensible portion connected to said ripper for selectively positioning the ripper relative to and independently of said connecting means.

DETAILED DESCRIPTION

Figure 1:
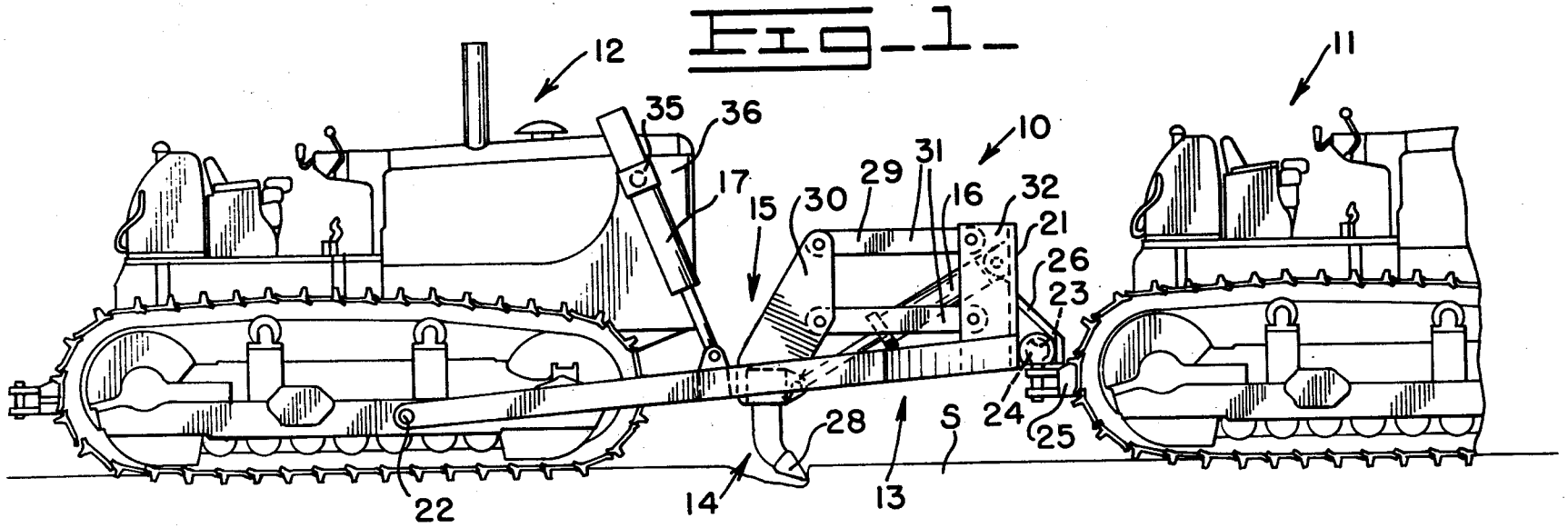
FIG. 1 is a fragmentary side elevation of a pair of series tandem connected track-type tractors provided with a ripper assembly embodying the invention.
Figure 2:
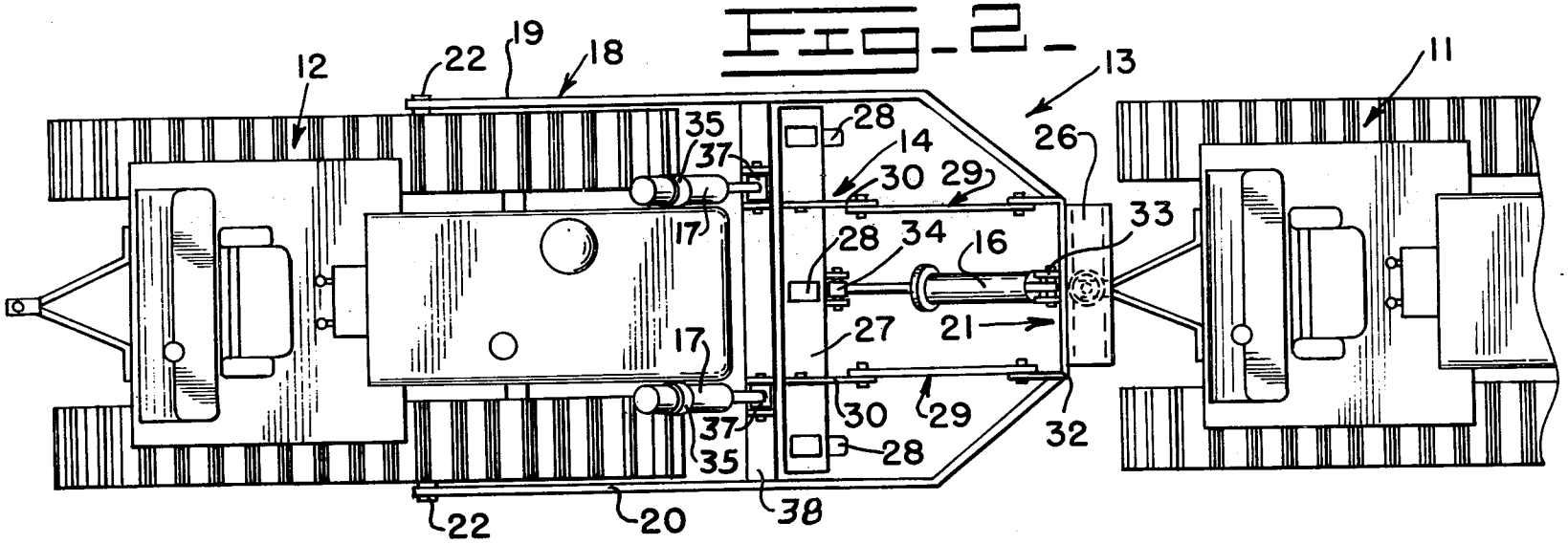
FIG. 2 is a fragmentary top plan view thereof.

In the exemplary embodiment of the invention as disclosed in FIGS. 1 and 2 of the drawings, a ripper assembly generally designated 10 is shown for use in connection with a pair of traction units generally designated 11 and 12. In the embodiment of FIGS. 1 and 2, the traction units comprise track-type tractors and the ripper assembly defines a connecting means generally designated 13 for selectively connecting the tractors in series tandem relationship, as shown in FIG. 1. The ripper generally designated 14 of the ripper assembly is effectively carried on the connecting means and is adjustably positioned thereon by adjusting means generally designated 15 comprising a jack 16.

As best seen in FIG. 2, the connecting means 13 is defined by a U-shaped frame 18 having legs 19 and 20 and a bight 21. The frame straddles the front portion of the rear tractor 12 and is connected to the rear tractor by suitable pivot pins 22 through legs 19 and 20, respectively, permitting the frame to swing downwardly and upwardly about the common axis of the pins.

A ball socket 23 is secured to the bight 21 of the frame for cooperation with a ball 24 mounted to the rear of the front tractor 11 by a drawbar bracket 25. The ball and socket connection may be protected by an overlying cover 26 on frame bight 21.

Ripper 14 includes a cross member, or beam, 27 and a plurality of ripper tips, or teeth, 28 extending downwardly from the cross member for ripping the earth surface S as the tractors are moved forwardly with the ripper in the lowered operating position of FIG. 1. The cross member 27 is vertically adjustably mounted to a pair of parallelogram linkages 29 each having a connecting bracket 30 connected to the cross member 27 and links 31 connected between bracket 30 and a bracket 32 fixed to the bight 21 of frame 18.

As shown in FIG. 2, jack 16 is connected by a pivot 33 to the bracket 32 and by a pivot 34 to the cross member 27. A pair of jacks 17 are mounted on pivots 35 on opposite sides of the radiator guard 36 of the tractor 12. The piston rods of jacks 17 are pivotally connected at 37 to a cross member 38 extending between and having its opposite ends connected to the legs 19 and 20.

As indicated above, means are kwown for controlling the driving and steering of series tandem connected tractors and the present invention comprehends the use of such known control means, as illustrated in U.S. Pat.

No. 3,245,488 of Robert A. Peterson and No. 3,324,963 of Donald H. Stroot et al, owned by the assignee hereof. The operation of jacks 16 and 17 may similarly be coordinated to permit operation of the entire tandem assembly and ripper means by a single operator, as desired.

Jack 16 can be suitably operated to position the ripper tips 28 relative to and independently of the connecting means 13 for ripping operation, as illustrated in FIG. 1. The wieght of the front end of tractor 12 may be utilized to effect the desired penetration by the ripper tips by suitable adjustment of the jacks 17 on the connecting means. The frame 18 defines not only the means for connecting the tractors in series tandem relationship, but also provides the means for applying the downward thrust from tractor 12 on the ripper tips by means of jacks 16 and 17.

The ripper assembly 10 further provides an improved facility in the connection and disconnection of the tractors. Upon release of the lock means associated with the ball and socket joint 23, 24, the jacks 17 are retracted to pivot the frame 18 about the pivots 22 and raise the bight 21 relative to the drawbar bracket 25. Upon separation of the conventional air hoses and control elements between tractors 11 and 12, the tractors are now available for independent operation. In such independent operation, tractor 11 is fully disconnected from the ripper assembly and tractor 12 may be operated with the ripper assembly connected thereto but in a retracted, upper position.

Reconnection of the tractors is simply effected by a reverse operation, as discussed above whereupon extension of the jacks 17 with tractor 11 suitably positioned permits the ball and socket joint 23, 24 to be reconnected to the drawbar bracket 25. Reconnection of the interconnecting hoses and controls between the tractors may then be effected for tandem operation of the tractors, as shown in FIGS. 1 and 2.

Figure 3:
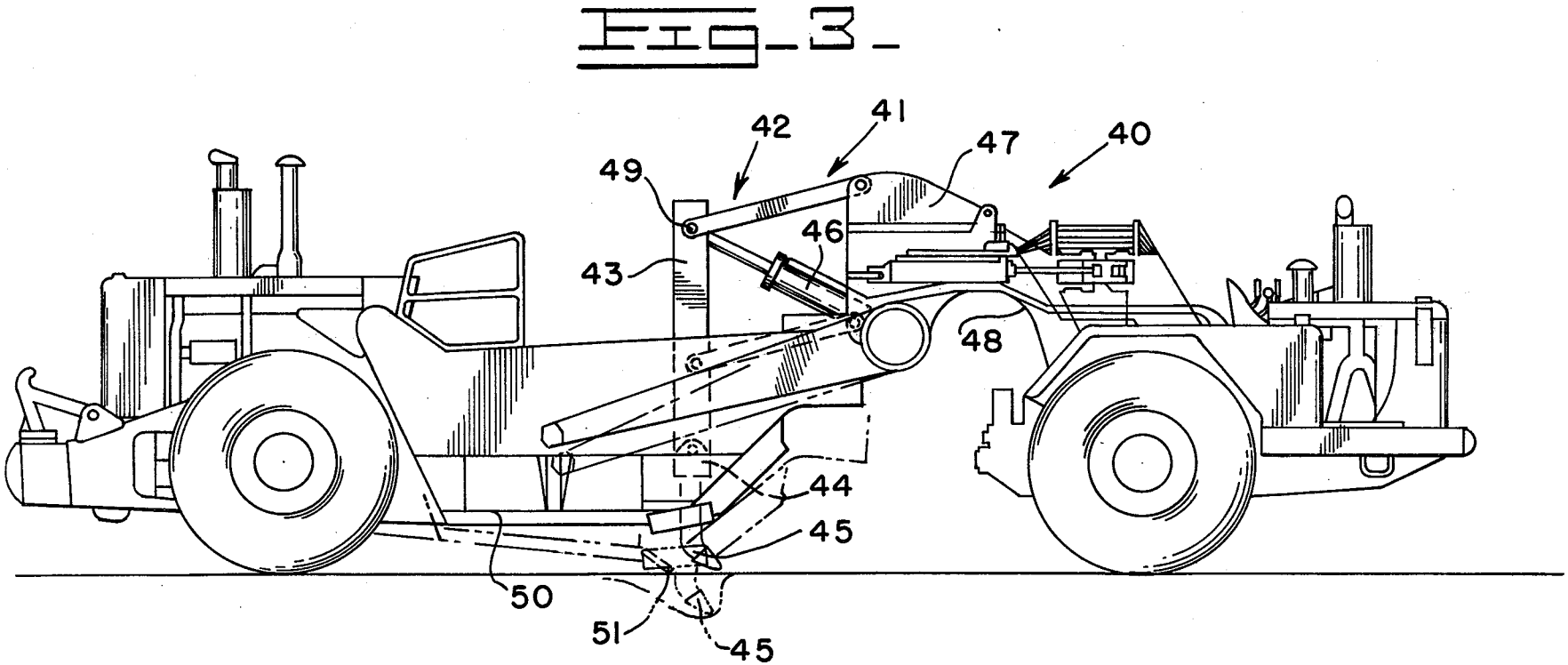
FIG. 3 is a side elevation of a dual-powered articulated scraper provided with ripper means embodying the invention.

Referring now to FIG. 3, a production-type tandem powered articulated scraper generally designated 40 is provided with a ripper assembly generally designated 41 having a parallelogram mounting linkage 42 carrying one or more vertical supports 43 each carrying at their lower end a ripper shank 44 and ripper tips, or teeth, 45.

A jack 46 is connected to a central upright portion 47 of the scraper draft frame 48. The jack is connected by a suitable pivot 49 to the linkage 42 and support 43 for adjustably vertically positioning the ripper tips 45. Shank 44 illustratively may comprise a cross member similar to cross member 27 of ripper assembly 10 where a plurality of jacks 46 and linkages 42 are provided at opposite ends thereof.

The scraper is provided with a scraper bowl 50 having a forward cutting edge 51. The bowl may be adjusted by the normal control means of the scraper to position edge 51 directly behind the ripper tips 45, as shown in dotted lines in FIG. 3, to provide a rigid backup support for the ripper tips. The backup of the ripper tips prevents distortion of the cross member, where used, by horizontal turning forces without requiring excessively heavy-duty jacks 46 and linkage means 42.

Thus, in the embodiment of FIG. 3, the rear traction unit effectively defines means for supporting the ripper assembly against distortion during ripping operation while yet permitting the ripper assembly structure to be relatively light. The ripper tips may be readily adjusted by the jacks 46 for ripping operation or disposition in a retracted position, as shown in full lines in FIG. 3, as desired.

Figure 4:
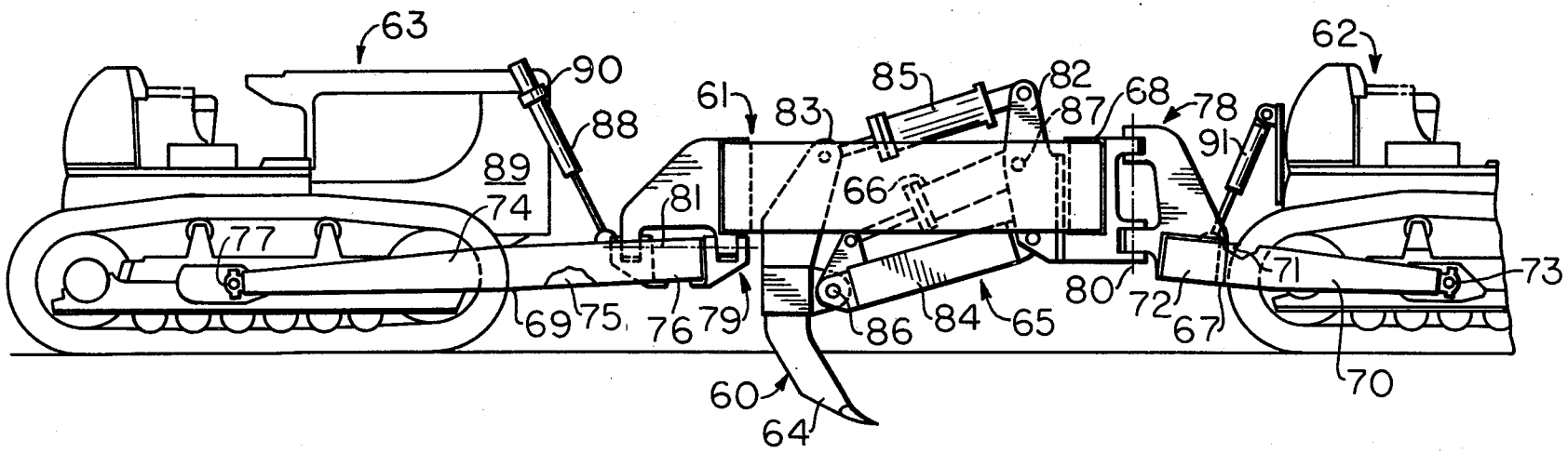
FIG. 4 is a side elevation of a pair of series tandem connected track-type tractors provided with a ripper assembly embodying the invention.

Referring now to FIG. 4, another embodiment discloses a ripper assembly 60 carried by a connecting means 61 which connects first and second track-type tractors in series tandem relationship. A ripper 64 of the ripper assembly is adjustably positionable relative to and independently of the connecting means by adjusting means generally designated 65 comprising a jack 66.

The connecting means 61 includes first, second and third frames 67, 68, 69, respectively. The first frame has a substantially "U" shape and has a pair of legs 70, 71 extending longitudinally forwardly from a transverse portion 72. The first frame stradles the rear portion of the first tractor 62 and is connected to the first tractor by suitable pivot pins, one shown at 73. The third frame is also substantially "U" shaped and has a pair of legs 74, 75 extending longitudinally rearwardly from a transverse portion 76. The third frame straddles the front portion of the second tractor 63 and is connected to the second tractor by suitable pivot pins, one shown at 77. The forward end of the second frame 68 is connected to the transverse portion 72 of the first frame 67 by a vertical pivot connection 78. The rearward end of the second frame is pivotally connected to the transverse portion 76 of the third frame 69 by a longitudinally extending pivotal connection 79.

The vertical pivotal connection 78 permits the first frame 67 and hence the first tractor 62 to pivot about a vertical axis generally designated at 80 during steering of the tractors, for example. The longitudinal pivotal connecton permits the third frame 69 and hence the second tractor 63 to pivot about a horizontal axis generally designated 81 when the tractors are traveling on rough, uneven surfaces.

The ripper assembly 60 includes a parallelogram type linkage having first and second upwardly extending brackets 82, 83, a lower link 84 and an upper link in the form of a hydraulic jack 85. The jack 66 is connected by a pivot 86 to the second bracket 83 and by a pivot 87 to the first bracket 82. The ripper 64 is connected to the second bracket. Thus, retraction of the jack 66 raises the ripper relative to the second frame 68 of the connecting means 61 while extending the jack lowers the ripper 64 relative to the connecting means. Extending and retracting the hydraulic jack 85 functions to adjust the angle of the ripper.

A pair of hydraulic jacks, one shown at 88, are positioned on opposite sides of the radiator guard 89 of the second tractor, each jack being mounted on a pivot 90. The rod end of each jack is pivotally connected to the third frame 69. A hydraulic jack 91 is mounted to the rear of the first tractor 62 and has its rod end pivotally connected to the first frame 67. By hydraulically locking the jacks in a fixed position, the first and second tractors 62, 63 and the first, second and third frames 67, 68, 69 act as a rigid frame so that the total weight of both tractors can be applied to the ripper for penetration into the surface.

Other aspects, objects and advantages of this invention can be obtained from a study of the drawings, the disclosure and the appended claims.

What is claimed is:

1. Earthmoving apparatus comprising:

a first traction unit;

a second traction unit;

connecting means for connecting the second traction unit to the first traction unit in rearwardly spaced relationship, said connecting means including first, second, and third frames, said first frame being pivotally connected to said first traction unit, said third frame being pivotally connected to said second traction unit, and means for pivotally connecting the second frame to the first and third frames;

a ripper carried by said second frame intermediate said traction units;

adjusting means for selectively adjusting the positioning of said ripper on said connecting means, said adjusting means including a jack having a first portion carried by said connecting means and a second selectively extensible portion connected to said ripper for selectively positioning the ripper relative to and independently of said connecting means; and wherein said means for pivotally connecting includes a vertically extending pivotal connection connecting said second frame to the first frame and a longitudinally extending pivotal connection connecting the second frame to the third frame.

2. The earthmoving apparatus of claim 1 including a second jack having a first portion carried by said second traction unit and a second selectively extensible portion connected to said third frame.

3. The earthmoving apparatus of claim 2 including a third jack having a first portion carried by said first traction unit and a second selectively extensible portion connected to said first frame.

4. Earthmoving apparatus comprising:

a first traction unit;

a second traction unit;

connecting means for connecting the second traction unit to the first traction unit in rearwardly spaced relationship;

a ripper carried by said connecting means intermediate said traction units;

an adjusting means for selectively adjusting the positioning of said ripper on said connecting means, said first and secnd traction units comprising front and rear portions of a dual-powered articulated scraper having a scraper bowl defining a front edge portion, said ripper being carried on said connecting means forwardly adjacent said front edge portion to be rearwardly supported thereby during ripping operation.

* * * * *